US005339960A

United States Patent [19]

Price

[11] Patent Number: 5,339,960

[45] Date of Patent: Aug. 23, 1994

[54] CHILD RESISTANT PACKAGE AND METHOD FOR MAKING SAME

[75] Inventor: Jerry D. Price, Indianapolis, Ind.

[73] Assignee: Eli Lilly and Company, Indianapolis, Ind.

[21] Appl. No.: 934,783

[22] Filed: Aug. 24, 1992

[51] Int. Cl.[5] ..... B65D 83/04

[52] U.S. Cl. ..... 206/531; 206/532; 206/534.1

[58] Field of Search ..... 206/469, 528, 530, 531, 206/532, 534.1

[56] References Cited

U.S. PATENT DOCUMENTS

| | | | |
|---|---|---|---|
| Re. 29,705 | 7/1978 | Compere | 206/531 |
| 3,835,995 | 9/1974 | Haines | 206/42 |
| 3,912,081 | 10/1975 | Haines et al. | 206/531 |
| 3,921,805 | 11/1975 | Compere | 206/532 |
| 3,924,746 | 12/1975 | Haines | 206/530 |
| 3,924,747 | 12/1975 | Gerner | 206/531 |
| 4,125,190 | 11/1978 | Davie, Jr. et al. | 206/469 |
| 4,158,411 | 6/1979 | Hall et al. | 206/531 |
| 4,506,789 | 3/1985 | Dlugosz | 206/532 |
| 4,537,312 | 8/1985 | Intini | 206/531 |
| 4,795,081 | 1/1989 | Miller | 229/19 |
| 4,958,736 | 9/1990 | Urheim | 206/531 |
| 5,046,618 | 9/1991 | Wood | 206/532 |
| 5,172,812 | 12/1992 | Wharton et al. | 206/532 |

FOREIGN PATENT DOCUMENTS

| | | | |
|---|---|---|---|
| 8804264 | 6/1988 | World Int. Prop. O. | 206/528 |

*Primary Examiner*—David T. Fidei

*Attorney, Agent, or Firm*—Woodard, Emhardt, Naughton, Moriarty & McNett

[57] ABSTRACT

A child-resistant package for tablets, capsules and the like includes a plurality of bubble chambers; a rupturable barrier bonded to each bubble chamber to seal the tablet in the bubble chamber. A top layer covers the rupturable barrier and defines an access panel which may be peeled away along first score lines to a first access position. An intermediate layer is sandwiched between the rupturable layer and the top layer and includes second score lines which define a breakaway panel. The bubble chamber, access panel and breakaway panel are aligned and operable such that a tablet in the bubble chamber may be extricated by first peeling back the access panel to the first access position to reveal the breakaway panel, and then pushing against the bubble chamber to force the tablet against the rupturable layer until the rupturable layer ruptures and the breakaway panel breaks away to expose the tablet.

17 Claims, 2 Drawing Sheets

CHILD RESISTANT PACKAGE AND METHOD FOR MAKING SAME

FIELD OF THE INVENTION

The present invention relates to the field of packaging and more particularly to child-resistant, single-dosage, blister-type packaging for tablets, capsules, and the like.

BACKGROUND OF THE INVENTION

The common single-dosage blister package comprises a sheet with transparent bubble chambers for holding a tablet, capsule or the like. The ultimate goal is to produce such a package which is child resistant, but adult friendly. Some of the designs produced heretofore achieve this goal better than others. For example, in U.S. Pat. No. 3,924,746, a package is described in which a scored tab is pulled off of the packaging, leaving a separation area whereby a single laminate may be pulled away from a bubbled carrier layer to expose the product. Similarly, in the packaging disclosed in U.S. Pat. No. 3,921,805, bending a tab reveals an unsealed area at which a laminate may be peeled away from the product-containing carrier layer. A similar, but somewhat more complicated opening procedure is disclosed in U.S. Pat. No. 3,835,995, in accordance with which a single dose package is first separated along score lines from other such packages. On the separated package, a tear-off strip must then be torn away along another set of score lines. A laminate may then be peeled away from the product-containing carrier to reveal the product. This design also includes selective bonding between layers to produce a starting region to begin peeling one layer from another.

Another form of packaging includes the bottom side of the bubble sheet being covered with a rupturable layer of foil or similar material. The user depresses tile transparent bubble, thereby forcing a tablet against the foil layer which is then ruptured. Further pressure on the bubble expels the tablet through the ruptured foil. Some packages couple this rupturable layer concept with a peelaway step. For example, in the packaging of U.S. Pat. No. Re 29,705, access to the blister chamber is attained first by pulling a tab which separates first and second layers of a laminate, and second by pushing the product through the second, rupturable laminate layer which is bonded to the bottom of the blister chamber. In accordance with U.S. Pat. No. 3,912,081, pulling on a tab separates a section of a first layer along score lines from the second layer, and the product is then pushed through the rupturable second layer. In a similar type of package, paperboard sheet is interposed between the rupturable layer and the layer having the scored, peelaway section. The intermediate sheet defines openings corresponding to the product placements such that, when a section of the peelaway layer is peeled away, the product may be pushed through the rupturable layer and through the corresponding opening in the intermediate paperboard sheet. These layers are bonded together except for the area between the intermediate sheet and the peel away section.

All of these types of packages are an attractive curiosity for young children. What is needed is an improved single-dosage, blister-type package which limits the ability of children to solve the puzzle of getting to the visible pill, but which does not unduly bar adults from access.

SUMMARY OF THE INVENTION

Generally speaking, a package is provided which holds single dose tablets, capsules and the like, and which provides fairly easy access by adults, but which is not readily accessed by children.

A child-resistant package includes a plurality of tablet containing bubble chambers; a rupturable barrier bonded to each bubble chamber to seal tile tablet in the bubble chamber; a top layer covering the rupturable barrier and defining an access panel which may be peeled away along first score lines to a first access position; and an intermediate layer sandwiched between tile rupturable layer and the top layer and having second score lines which define a breakaway panel. The bubble chamber, access panel and breakaway panel are aligned and operable such that a tablet in the bubble chamber may be extricated by first peeling back the access panel to the first access position to reveal the breakaway panel, and then pushing the bubble chamber to force the tablet against the rupturable layer until that layer ruptures and the breakaway panel breaks away to expose the tablet.

It is an object of the present invention to provide an improved package system for single unit tablets, capsules and the like.

It is another object of the present invention to provide single-dosage, blister-type packaging that is child resistant, but adult friendly.

Further objects and advantages of the present invention will become apparent from the following description of the preferred embodiment of the present invention.

DESCRIPTION OF THE PREFERRED EMBODIMENT

Figure 1:
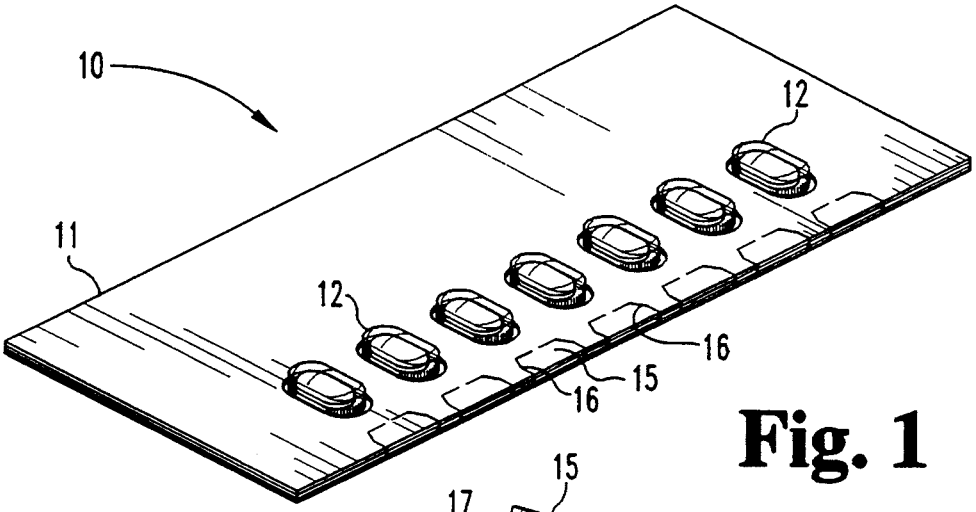
FIG. 1 is a perspective view of a child-resistant package 10 in accordance with the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and any alterations and modifications in the illustrated device and any further applications of the principles of the invention as illustrated therein are contemplated as would normally occur to one skilled in the art to which the invention relates.

Figure 2:
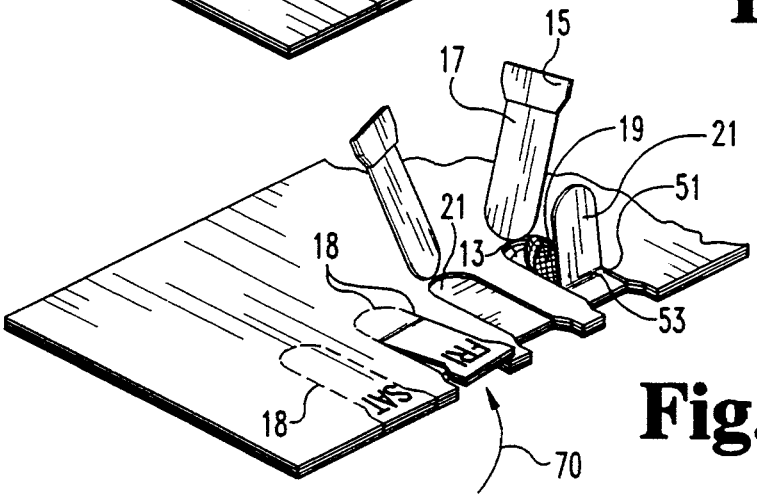
FIG. 2 is a fragmented perspective view of the underside of the package 10 and showing two access panels peeled back and a breakaway panel pushed through the access opening created thereby.
Figure 6:
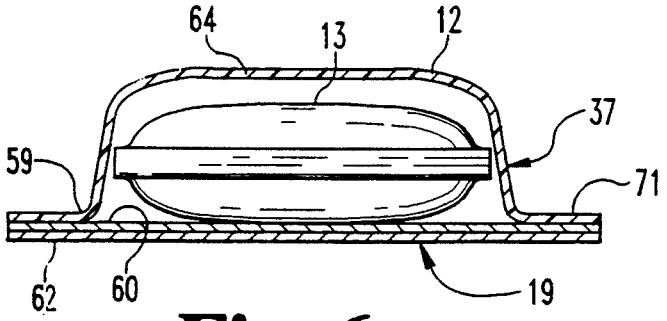
FIG. 6 is a cross-sectional view of the blister pack 37 of package 10 of FIG. 1 cut across the center line of a tablet.

Referring to FIGS. 1 and 2, there is shown a child-resistant package 10 in accordance with the preferred embodiment of the present invention. Package 10 includes a body 11 with a number of transparent bubble chambers 12, each of which contains a unit of product 13 (FIG. 6). For convenience of description, the packaging is described hereafter as containing tablets, although capsules and the like may similarly be contained and dispensed. Package 10 is shown with chambers for seven single dosages of tablets 13, e.g., one for each day of the week. Generally, access to each tablet 13 is provided by bending a tab 15 at predefined cuts 16, peeling back the tab 15 and the access panel 17 bonded thereto along predefined score lines 18. The enclosed tablet 13 is then pushed through a rupturable barrier 19 and past a bendable breakaway panel 21.

Figure 3:
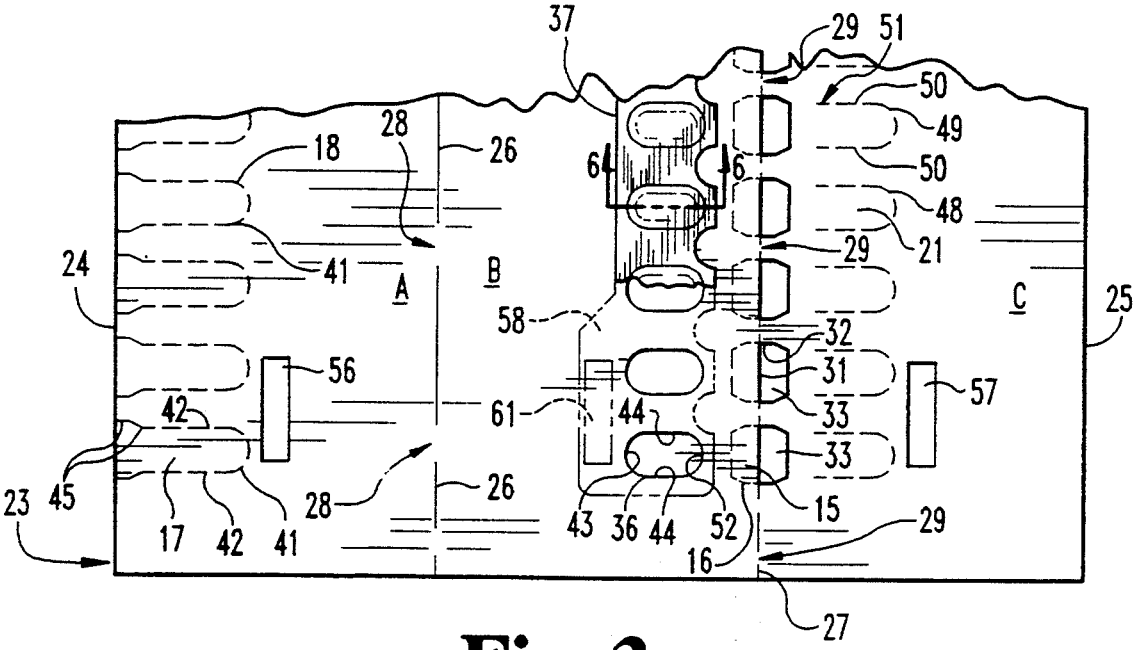
FIG. 3 is a fragmented plan view of a single blank of the package of FIG. 1 scored in accordance with the present invention.

Referring now to FIG. 3, there is shown a single blank 23 made of paperboard and having various cuts and scores to form package 10. Preferably, the paperboard blank 23 is die cut all at once, such as in a Bobst die-cutter.

Figure 4:
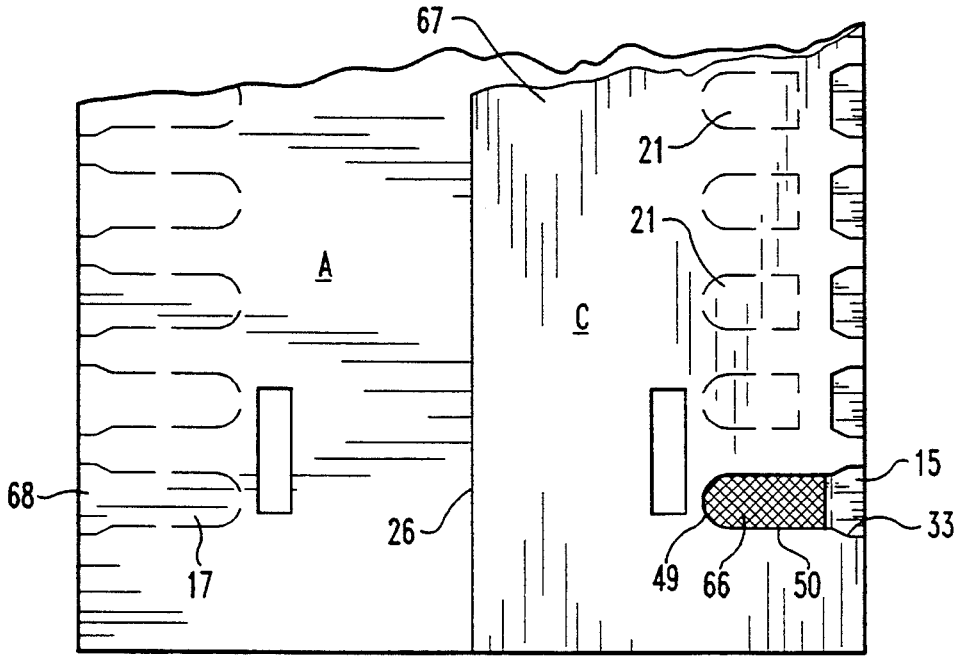
FIG. 4 is a plan view of tile blank of FIG. 3 with the right hand portion C folded on top of the middle portion B.
Figure 5:
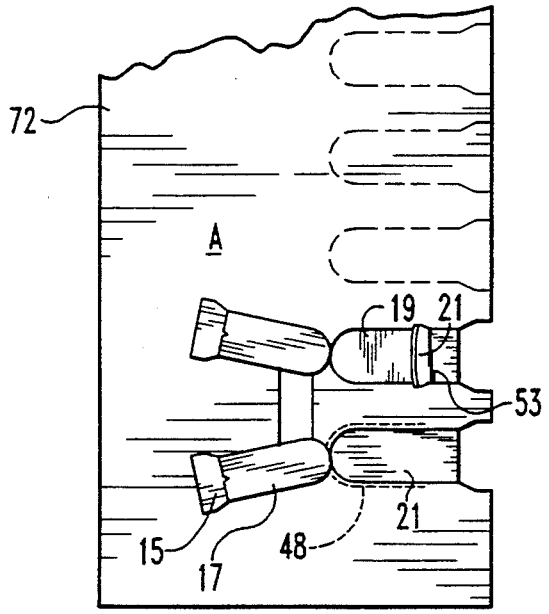
FIG. 5 is a plan view of the underside of the package of FIG. 1 and showing two access panels peeled back and a breakaway panel pushed through the access opening created thereby to reveal the underlying breakaway panel.

Parallel to opposing edges 24 and 25, there are defined non-continuous and mutually parallel score lines 26 and 27, which delimit generally identically sized rectangular panels A, B, and C. Score lines 26 and 27 enable panel C to be folded about score line 27 and onto panel B (FIG. 4), and then panel A to be folded about score line 26 and onto panel C (FIG. 5).

As used herein, the phrases "score line" and "score lines" are used interchangeably to describe either a single cut or plurality of cuts in blank 23 so that one portion is separable from another. For example, score line 26 is preferred to be non-continuous with the several unscored portions, such as at 28, holding panels A and B together during the folding assembly. However, score lines 26 could comprise just one score line extending between, but not all the way to the opposing top edge (not shown) and bottom edges 30 of blank 23. Likewise, score line 27 is preferred to define a number of smaller, unscored regions or nicks, such as at 29, to help hold panel C connected with panel B as panel C is folded relative to panel B.

Additional scores or cuts 32 in blank 23 intersect with lengths 31 of line 27 to define seven equally spaced, identical hexagonal cut-outs 33. There is an unscored region or nick 29 defined between each cut-out 33. On the opposite side of line 27, panel B of blank 23 is scored at 16 to define seven removal tabs 15, each tab 15 being roughly a mirror image of its corresponding cut-out 33 about line 27.

Panel B is also cut to define seven identical oval cut-outs 36, each cut-out 36 horizontally corresponding with an adjacent tab 15 and hexagonal cut-out 33. A blister pack 37, having seven bubble chambers 12 may thus be received against panel B with each blister chamber 12 extending through a corresponding oval cut-out 36.

Non-continuous score lines 18 are defined in panel A to form peelaway access panels 17, as shown in FIG. 3. For each access panel 17, the inner arcuate portion 41 of its score lines 18 and the pair of opposing, straight portions 42 of its score lines 18 are configured to roughly correspond with the inner arcuate portion 43 and pair of opposing, straight portions 44, respectively, of the corresponding oval cut-out 36. The outer straight and angled portions 45 of score lines 18 of each panel 17 are configured to mirror the shaped and angled portions of score lines 16 of the horizontally corresponding tab 15. The reasons for these relationships among the various sets of score lines 16 and 18 and cut-outs 36 will become apparent herein.

Non-continuous score lines 48 are defined in panel C to produce seven bendable, breakaway panels 21 which horizontally correspond with the seven tabs 15, oval cut-outs 36 and peelaway access panels 17. Arcuate portions 49 of score lines 48 correspond generally to the inner arcuate portions 43 of the corresponding oval cut-outs 36. From each arcuate portion 49, score lines 48 extend straight at 50 toward line 27, to correspond generally with the pair of opposing, straight portions 44 of the corresponding oval cut-outs 36. Each pair of straight score lines 50 stops at 51, short of intersecting with cut-outs 33 and without continuing into arcuate score lines which would correspond with the inner curved portion 52 of cut-outs 36. Instead, each pair of straight score lines 50 stops as at 51 so that, when pressure is applied to the region roughly bounded by score lines 48, an access panel 21 will break away from the rest of panel C and bend at 53 as shown in FIG. 2, roughly between the termination points 51 of score lines 50. For reasons which will become apparent below, the width of panel 21 between parallel score lines 50 is preferably slightly greater than the width of access panel 17 between its parallel score lines 42. Panels A and C are also provided with rectangular cut-outs 56 and 57, respectively, which, when panel C is folded onto panel B and panel A then is folded onto panel C, will align and provide an external view of an enlarged section 58 of blister pack 37.

Referring to FIG. 6, each blister pack 37 is produced as a unit, whereby a sheet of transparent vinyl such as polyethylene or polyvinyl-chloride is processed to form an upper layer 59 with seven spaced-apart blisters or bubble chambers 12. The material comprising layer 59 should be sufficiently strong to resist biting or tearing by a child. The bubble chambers 12 are formed in plastic layer 59 by any appropriate method such as vacuum-forming. The product (tablet 13) is then deposited into the bubble chambers 12, and a combined foil (60) and paper (62) laminate backing is heat-sealed to the vinyl blister, thereby sealing the tablets in the respective bubble chambers.

The foil and paper layers together create rupturable barrier 19. The control number and expiration date are printed onto the enlarged portion 58 in a position making it visible through rectangular cut-outs 56 and 57 when package 10 is completely assembled. (FIG. 3) The combined thickness and the strength of foil layer 60 and paper layer 62 are provided so that, by applying pressure against the top 64 of bubble chamber 12, tablets 13 can be manually forced against and rupture the barrier 19 to expose and release the tablet. In one embodiment, paper layer 62 comprises fifteen pound paper.

The paperboard is treated on the "top" side (the side visible in FIG. 3) with a suitable heat bonding substance, typically prior to cutting. Upon folding the paperboard, heat and pressure are applied to compress the two layers together to provide a strong bond between the two paperboard layers. The paperboard is printed with desired indicia, such as dosage instructions and day-of-the-week information (FIG. 2).

On the "bottom" side of blank 23, a portion 66 of panel C corresponding to each bendable breakaway panel 21 is heavily varnished to negate the effect of heat-sealing in those locations between panels C and A. That varnished portion 66 (indicated as a cross-hatched region in FIG. 4) is essentially bounded along its sides by straight score lines 50 and at its ends by arcuate score lines 49 and the corresponding cut-out 33. When the varnishing step is performed may vary, but it is preferably performed before blank 23 has been scored.

With blank 23 having been printed, treated and cut as described and as shown in FIG. 3, and with the blister pack 37 prepared as described and as shown in FIGS. 6 and 3, a fully assembled pill package is prepared as follows.

Blank 23 is laid in an appropriate die and a blister pack 37 is laid atop the center rectangular panel B, as shown in FIG. 3, so that bubble chambers 12 extend downwardly, through oval slots 36. Heat and pressure are then applied to compress and bond panel B to the adjacent side 71 (FIG. 6) of blister pack 37. Panel C is then folded along line 27 atop panel B, as shown in FIG. 4, and panel A is then folded along line 26 over and atop panel C, as shown in FIG. 5. Heat and pressure are applied to bond panel C to the back of the blister pack 37 and to panel B, and to bond panel A to panel C. The application of heat and pressure is performed by a plate having reliefs corresponding to panels 21 so that little or no bonding occurs between panels 21 and the upwardly facing paper layer 62 of the underlying blister pack 37, or between bendable breakaway panels 21, and peelaway access panels 17. The heat sealing step also bonds the outer region 68 of each panel 17 to the corresponding and underlying tab 15. Package 10 is now fully constructed.

In use, referring to FIGS. 1, 2, and 5, the product contained within bubble 12 is accessed by grasping a tab 15 (actually comprising tab 15 and outer region 68, but referred to collectively hereinafter as tab 15) between two fingers and bending it in the direction of arrow 70. Continued pulling of tab 15 pulls it and access panel 17 away from tile remainder of package 10, thereby revealing most of breakaway panel 21 as shown in FIGS. 2 and 5. Because of the varnished portion 66 and selective application of heat and pressure to panels A and C, access panel 17 pulls cleanly away from the breakaway panel 21 therebelow.

Because the width of each panel 21 is greater than the width of each corresponding access panel 17, the score lines 48 of panels 21 are not visible when access panel 17 is peeled away, as shown in FIG. 5, but are concealed below the remaining portion of panel A. If a child had peeled access panel away as described above, he or she, not seeing the foil layer here revealed in prior art designs, might be less likely to play with or investigate the package further to access the enclosed tablet 13. Also, the child, not seeing the score lines 48 of panel 21, would not thereby be alerted that panel 21 is removable and try to peel it up. The existence of panel 21 also protects the underlying, more fragile foil/paper barrier 19 therebelow in the event that access panel 17 is inadvertantly peeled back.

In addition, with the outer edges of breakaway panels 21 (up to score lines 48) positioned under the panel A (FIG. 5), slightly more pressure is required to be applied to push a tablet through rupturable barrier 19. With panel 21 peeled back as shown in FIGS. 2 and 5, tablet 13 is pushed, from the top 64 of chamber 12 (FIG. 6) until tablet 13 breaks through the rupturable foil and paper barrier 19 and breaks breakaway panel 21 away from its panel C along score lines 48. Panel 21 thereby bends away at 53 and reveals tablet 13.

Other embodiments are contemplated wherein bubble chamber 12 and the various cut-outs and panels are other than oval shaped and are provided in numbers other than the seven described herein. Embodiments are also contemplated wherein opposing straight portions 50 of score lines 48 extend all the way to cut-outs 33.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A child resistant package, comprising:

at least one bubble chamber for holding a product;

a rupturable barrier bonded to said bubble chamber to seal the product in said bubble chamber;

a top layer covering said rupturable barrier and including first score lines defining an access panel aligned over said bubble chamber and which may be peeled away along first score lines; and an intermediate layer sandwiched between said rupturable layer and said top layer and having second score lines which define a breakaway panel aligned with said bubble chamber;

a first access position including the access panel being peeled up and away to create a first access opening and to expose the underlying breakaway panel, and further including said breakaway panel remaining intact when said access panel is peeled away;

wherein said bubble chamber, access panel and breakaway panel are interoperable to permit a tablet in said bubble chamber to be extricated by first peeling back said access panel to the first access position to create a first access opening revealing said breakaway panel and then by pushing against said bubble chamber to force the tablet against said rupturable layer until said rupturable layer ruptures and said breakaway panel breaks away to expose the tablet through the access opening.

2. The package of claim 1 wherein the first and second score lines are sized so that said second score lines are not exposed when the access panel is in the first access position.

3. The package of claim 2 wherein said second score lines are configured in the shape of a "C".

4. The package of claim 2 and further including a bottom layer having at least one bubble chamber opening, said bubble chamber and rupturable layer being preassembled into a blister pack and said blister pack resting atop said bottom layer with at least one bubble chamber extending down through a corresponding bubble chamber opening, said intermediate layer being atop said blister pack, said bottom, intermediate and top layers and said blister pack being mutually bonded together.

5. The package of claim 4 wherein one of the access panel and the breakaway panel are treated to prevent the access panel and breakaway panel from being bonded together when said intermediate layer and said top layer are bonded together.

6. The package of claim 5 wherein the bond preventing treatment comprises said intermediate layer including a varnish coating on said breakaway panels, the varnish coating preventing the access panel from being heat sealed to the breakaway panel.

7. The package of claim 4 and further including a second access position wherein the package is in the first access position and said breakaway panel is at least partially separated from the remainder of the intermediate layer and extending hingedly up through the first access opening.

8. The package of claim 7 wherein the package has opposing front and rear edges and includes a frangible tab at the front edge and connected with each access panel for initiating peeling of each access panel toward the rear edge.

9. A single blank having opposing top and bottom edges and first and second opposing and parallel edges and for forming a laminar, child resistant package, comprising:

horizontally aligned left, middle and right substantially identically sized rectangular panels, the left panel delimited from the middle panel by first score lines parallel to the first edge, and the right panel being delimited from the middle panel by second score lines parallel to the second edge;

the middle panel defining at least one bubble chamber opening sized to receive a bubble chamber of a blister pack therethrough; the right panel defining third score lines which define at least one breakaway panel; the left panel defining fourth score lines which define at least one frangible access panel, wherein the at least one opening, breakaway panel and access panel are defined on the blank such that, in a final folded position whereby the right panel is folded atop the middle panel along the second score lines and the left panel is subsequently folded atop the right panel along the first score lines, the access panel is disposed directly over the breakaway panel which is disposed directly over the opening.

10. The blank of claim 9 wherein there are a plurality of the at least one openings spaced between the top and bottom edges of the blank, and there are a corresponding plurality of the at least one breakaway panels and the at least one access panels likewise spaced between the top and bottom edges of the blank.

11. The blank of claim 10 and further including a first access position including the blank being in the final folded position and the access panel being peeled up and away to create a first access opening and to expose the underlying breakaway panel, and wherein the third score lines are located relative the fourth score lines so that, in the first access position, the third score lines are not exposed.

12. The blank of claim 11 and further including a second access position including the blank being in the first access position and the breakaway panel being at least partially separated from the remainder of the right panel and extending up through the first access opening.

13. The blank of claim 12 wherein one side of each breakaway panel is treated to prevent the breakaway panel from being bonded to the access panel when the left, middle and right panels are sealed together in the final folded position.

14. The blank of claim 12 wherein the blank further includes a plurality of score lines and cut-outs which, when the blank is in the final folded position, define a plurality of tabs for initiating peeling each access panel away.

15. The blank of claim 14 wherein the blank, in the final folded position, has opposing front and rear edges and wherein the plurality of tabs are defined along the front edge for pulling each access panel toward the rear edge.

16. The blank of claim 12 wherein the third score lines are generally C-shaped and each breakaway panel forms a hinged flap in the second access position.

17. A method for making a child-resistant package, comprising the steps of:

providing a single blank having opposing top and bottom edges and first and second opposing parallel edges;

making cuts in said blank to define horizontally-aligned left, middle and right substantially identically-sized rectangular panels, the left panel delimited from the middle panel by first score lines parallel to the first edge, and the right panel delimited from the middle panel by second score lines parallel to the second edge;

making cuts in the middle panel to define at least one bubble chamber opening sized to receive a bubble chamber of a blister pack therethrough;

making third score lines in the right panel to define at least one breakaway panel;

making fourth score lines in the left panel to define at least one tangible access panel;

providing a blister pack having at least one bubble chamber;

positioning said blister pack atop the middle panel whereby the bubble chamber extends downwardly through a corresponding bubble chamber opening;

folding the right panel to a first folded position atop the blister pack and middle panel, followed by folding the left panel to a final folded position atop the right panel, the final folded position including the access panel being aligned directly over both the opening and the breakaway panel, whereby peeling back the access panel reveals the breakaway panel; and bonding the left, middle, and right panels together.

* * * * *